US012589275B2

(12) United States Patent
Washington

(10) Patent No.: US 12,589,275 B2
(45) Date of Patent: Mar. 31, 2026

(54) MULTIFUNCTIONAL AND ADJUSTABLE RESISTANCE TRAINING DEVICE

(71) Applicant: Kenneth Cigril Washington, Greensboro, NC (US)

(72) Inventor: Kenneth Cigril Washington, Greensboro, NC (US)

( * ) Notice: Subject to any disclaimer, the term of this patent is extended or adjusted under 35 U.S.C. 154(b) by 32 days.

(21) Appl. No.: 18/434,457

(22) Filed: Feb. 6, 2024

(65) Prior Publication Data

US 2024/0261624 A1 Aug. 8, 2024

Related U.S. Application Data

(60) Provisional application No. 63/443,757, filed on Feb. 7, 2023.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/12*** | (2006.01) |

(52) U.S. Cl.

CPC .... *A63B 21/4025* (2015.10); *A63B 21/00178* (2013.01); *A63B 21/04* (2013.01); *A63B 21/0557* (2013.01); *A63B 23/1245* (2013.01); *A63B 2208/0204* (2013.01); *A63B 2209/10* (2013.01); *A63B 2244/10* (2013.01)

(58) Field of Classification Search

CPC ..... A63B 21/02–0557

See application file for complete search history.

(56) References Cited

U.S. PATENT DOCUMENTS

| | | | | |
|---|---|---|---|---|
| 5,308,305 A * | 5/1994 | Romney | A63B 21/4021 482/121 |
| 5,704,856 A * | 1/1998 | Morse | A63B 69/0002 473/212 |
| 5,813,955 A * | 9/1998 | Gutkowski | A63B 21/4007 482/121 |
| 6,244,994 B1 * | 6/2001 | Tilberis | A63B 21/4035 482/907 |
| 8,784,285 B1 * | 7/2014 | Lopez | A63B 21/0557 482/121 |
| 9,061,173 B1 * | 6/2015 | Felkel | A63B 69/0059 |
| 10,463,905 B1 * | 11/2019 | Smith, Jr. | A63B 21/0442 |

(Continued)

*Primary Examiner* — Nyca T Nguyen

(74) *Attorney, Agent, or Firm* — James G. Passe; Passe Intellectual Property, LLC

(57) ABSTRACT

The multifunctional resistance training device is intended to provide users with an adjustable upper body exercise device. The device includes a harness, a plurality of resistance bands, a plurality of tension straps, and a plurality of hand grips that are all interconnected with adjustable fasteners. More specifically, the device is adjustable, wherein the resistance levels of the bands, tension level on the grip, fit of the harness around the user's body, etc. may be adjusted to provide the user a perfect fit while engaging in resistance training. Further, the device may be used for providing additional support and resistance training for other activities such as push-ups, baseball, swimming, tennis, etc. Additionally, the device may be used for rehabilitation training and upper body strengthening. Thus, the multifunctional resistance training device may be used for improving power and speed in sports activities, as well as for rehabilitation training.

14 Claims, 9 Drawing Sheets

(56) References Cited

U.S. PATENT DOCUMENTS

| | | | | |
|---|---|---|---|---|
| 11,331,529 | B1 * | 5/2022 | Cranke | A63B 21/4021 |
| 11,759,689 | B2 * | 9/2023 | Jordan | A63B 21/4021<br>482/124 |
| 2002/0068667 | A1 * | 6/2002 | Strachan | A63B 21/4025<br>482/125 |
| 2005/0282689 | A1 * | 12/2005 | Weinstein | A63B 21/0552<br>482/121 |
| 2013/0143723 | A1 * | 6/2013 | Bender | A63B 21/02<br>482/121 |
| 2017/0106223 | A1 * | 4/2017 | Brancato | A63B 21/0557 |
| 2017/0291058 | A1 * | 10/2017 | Marji | A63B 23/03516 |
| 2019/0240529 | A1 * | 8/2019 | Burkinshaw | A63B 21/4043 |
| 2020/0338386 | A1 * | 10/2020 | Park | A63B 71/0054 |
| 2022/0264967 | A1 * | 8/2022 | Bassoo | A63B 21/4007 |
| 2023/0098142 | A1 * | 3/2023 | Bassoo | A63B 21/4007<br>482/105 |
| 2023/0173365 | A1 * | 6/2023 | Jordan | A63B 21/4009<br>482/124 |
| 2024/0017119 | A1 * | 1/2024 | Fazio | A63B 21/4007 |
| 2024/0041630 | A1 * | 2/2024 | Sullivan | A63B 21/00065 |
| 2025/0089822 | A1 * | 3/2025 | Bassoo | A41D 1/04 |

* cited by examiner

MULTIFUNCTIONAL AND ADJUSTABLE RESISTANCE TRAINING DEVICE

FIELD OF THE INVENTION

The present invention relates generally to an upper body exercise device. More specifically, the invention relates to a resistance training device designed for boxing and other combat sports, as well as rehabilitation training.

BACKGROUND OF THE INVENTION

It is a known fact that resistance training increases muscle strength by making your muscles work against a weight or force. In other words, resistance training is based on the principle that muscles of the body will work to overcome a resistance force when they are required to do so. When you do resistance training repeatedly and consistently, your muscles become stronger. In combat sports such as boxing, MMA, etc., players have to work on their reflexes as well as endurance. To build endurance, experts recommend punching bag training, shadow boxing, resistance workouts, etc. However, a device or equipment that can help with all these activities with adjustable resistance levels, and a grip hold that is best suited for the user, is a rare find in the current market.

An objective of the present invention is to provide users with an adjustable upper body exercise device. More specifically, it is an aim of the present invention to provide users with a resistance training device, wherein the resistance levels of the bands, tension level on the grip, fit of a harness around the user's body, etc. may be adjusted to provide the user a perfect fit while engaging in resistance training. Further, the present invention may be used for providing additional support and resistance training for other activities such as push-ups, baseball, swimming, tennis, etc. Additionally, the present invention may be used for rehabilitation training and upper body strengthening. Thus, the present invention is a multifunctional resistance training device that may be used for improving power and speed in sports activities, as well as for rehabilitation training, such as for shoulder rehabilitation post-surgery.

SUMMARY OF THE INVENTION

The multifunctional resistance training device is intended to provide users with an adjustable upper body exercise device. To that end, the present invention comprises a harness, a plurality of resistance bands, a plurality of tension straps, and a plurality of hand grips that are all interconnected with adjustable fasteners. More specifically, it is an aim of the present invention to provide users with a resistance training device, wherein the resistance levels of the bands, tension level on the grip, fit of the harness around the user's body, etc. may be adjusted to provide the user a perfect fit while engaging in resistance training. Further, the present invention may be used for providing additional support and resistance training for other activities such as push-ups, baseball, swimming, tennis, etc. Additionally, the present invention may be used for rehabilitation training and upper body strengthening. Thus, the present invention is a multifunctional resistance training device that may be used for improving power and speed in sports activities, as well as for rehabilitation training, such as for shoulder rehabilitation after surgery.

DETAIL DESCRIPTIONS OF THE INVENTION

Figure 1:
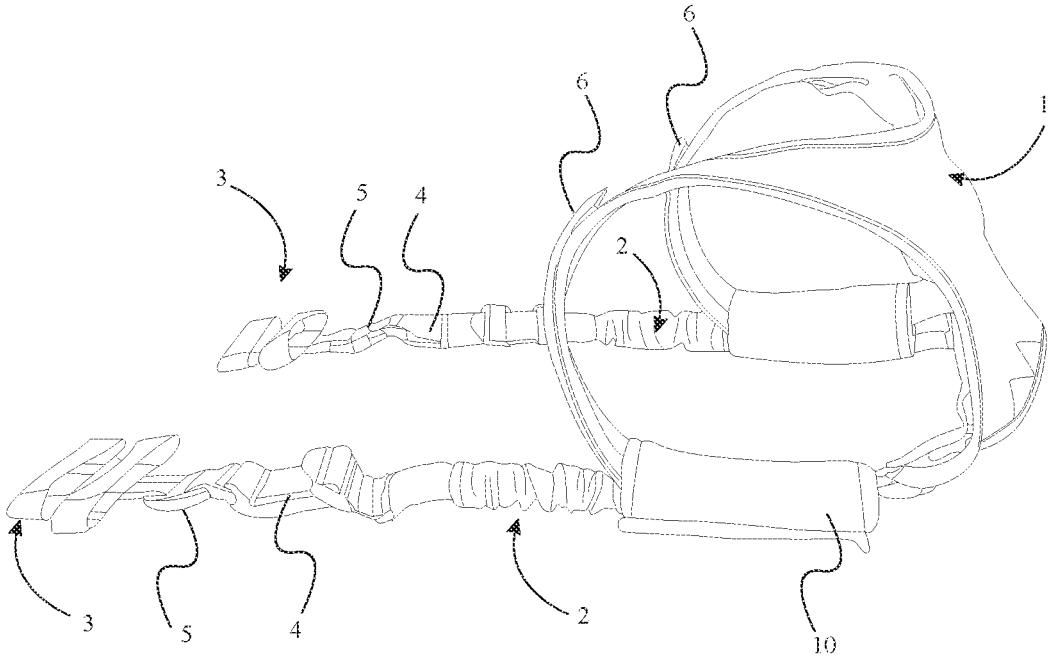
FIG. 1 is a top-rear-right perspective view of the present invention.
Figure 2:
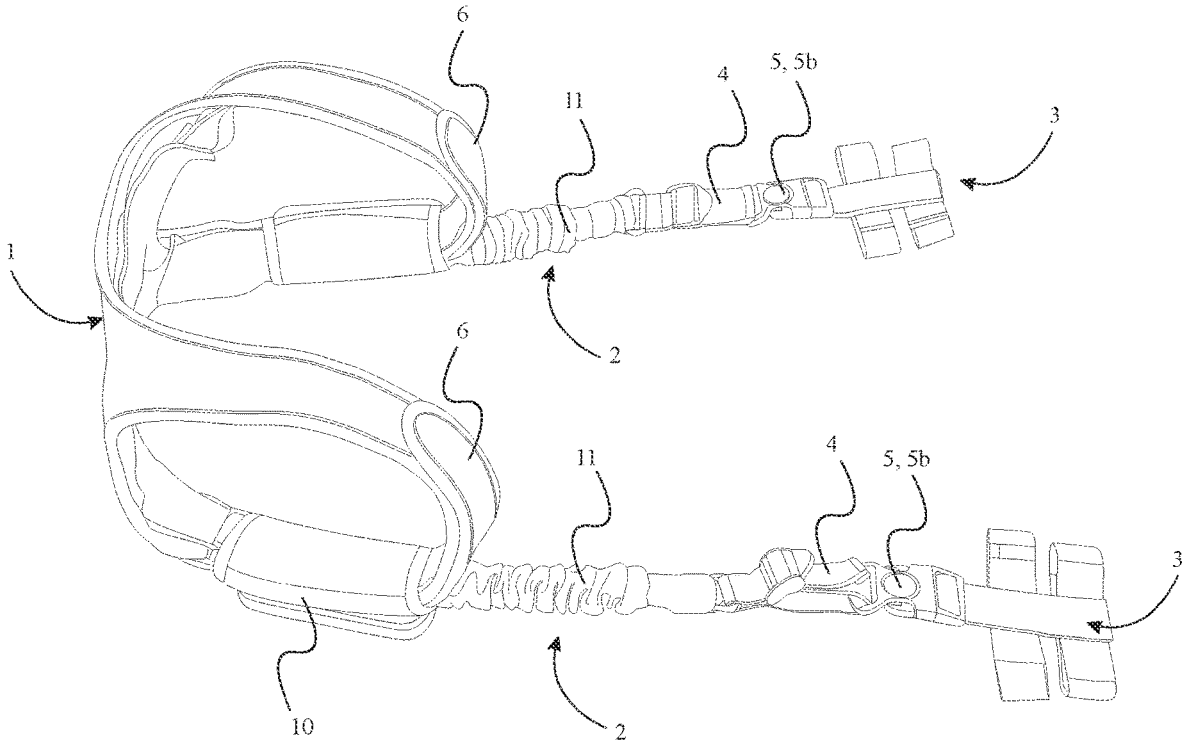
FIG. 2 is a top-front-left perspective view of the present invention.

All illustrations of the drawings are for the purpose of describing selected versions of the present invention and are not intended to limit the scope of the present invention.

In reference to FIG. 1 through FIG. 9, the present invention is a multifunctional resistance training device.

The following description is in reference to FIG. 1 through FIG. 9. According to a preferred embodiment, the present invention comprises a harness 1, a plurality of resistance bands 2, a plurality of hand grips 3, a plurality of tension straps 4, and a plurality of fasteners 5. Preferably, the harness 1 is the central support piece of the invention that goes around the shoulders and back of the user. The outer material of the harness 1 comprises nylon and safety pads are sown onto the harness 1 for comfort. Further, the present invention comprises a plurality of adjustable shoulder straps 6, that are integrated along the harness 1. The adjustable shoulder straps 6 and padding of the harness ensure a personalized fit, preventing any discomfort, and providing flexibility, comfort, and performance. However, the harness 1 may comprise any other material, components, arrangement of components, etc. that are known to one of ordinary skill in the art, as long as the intents of the present invention are fulfilled.

Figure 3:
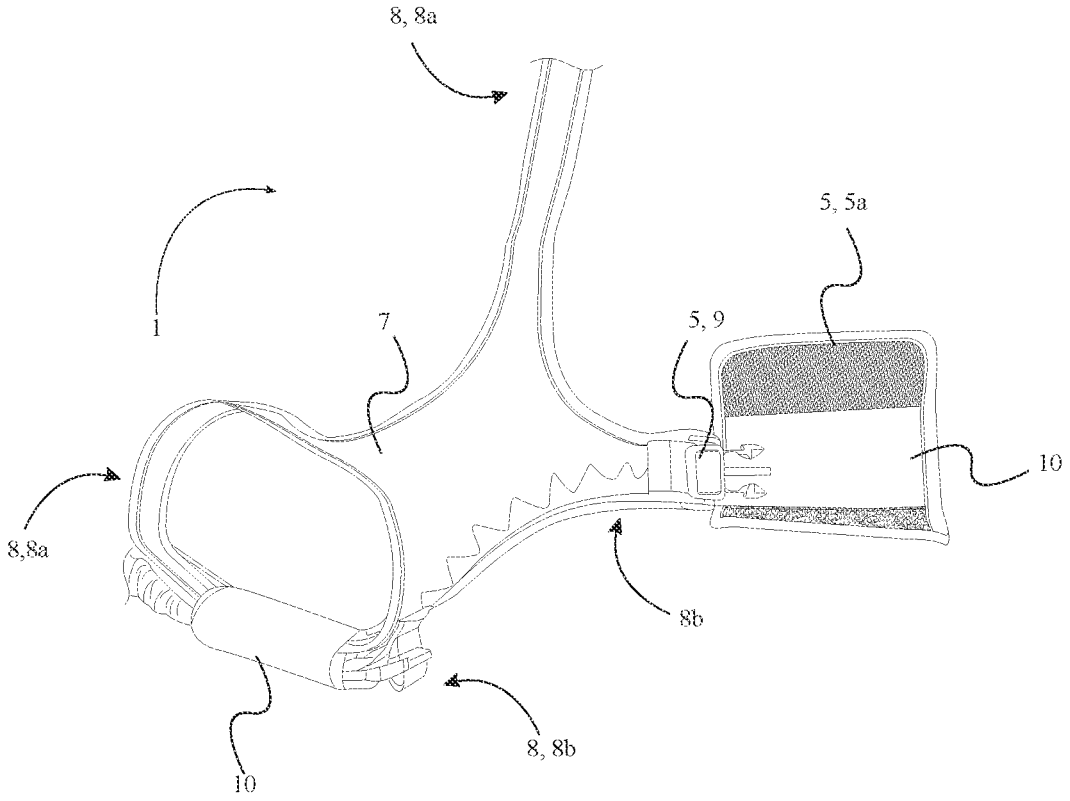
FIG. 3 is a front perspective view of the harness, wherein one of the harness fasteners and one of the protective coverings are in an open configuration.
Figure 5:
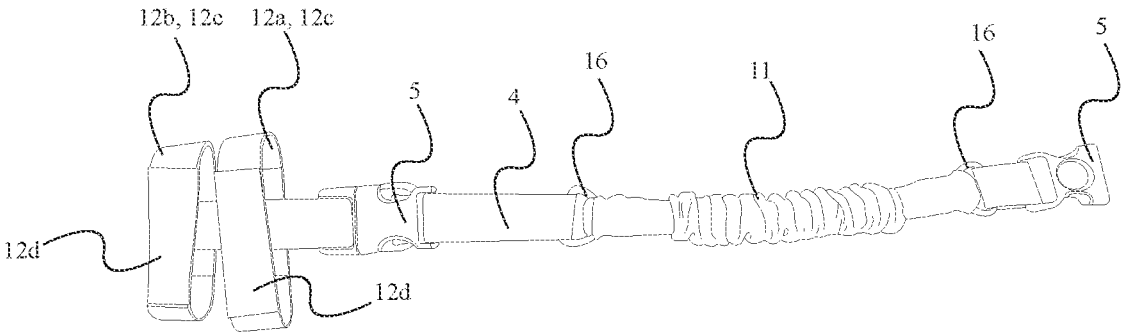
FIG. 5 is a top perspective view of the hand grip, the tension strap, the resistance band, and a plurality of fasteners.

According to the preferred embodiment, the plurality of resistance bands 2 is detachably connected between the harness 1 and the plurality of tension straps 4. The plurality of resistance bands 2 will allow users to add and release tension to the user's preference. To that end, the plurality of tension straps 4 helps users to pull and release the tension straps and adjust resistance level of the plurality of resistance bands 2. Accordingly, the plurality of tension straps 4 is connected between the plurality of resistance bands 2 and the plurality of plurality of hand grips 3. The plurality of hand grips 3 is intended to go around the users' hand in a snug yet comfortable fashion. In other words, the plurality of hand grips 3 is designed to fit several hand sizes. To that end, the plurality of resistance bands 2 and the plurality of hand grips 3 are flexible. Once the plurality of hand grips 3 is worn, users are able to shadowbox, and may place their hand inside any type of gloves such as Boxing Gloves, MMA gloves, UFC Gloves etc. In the preferred embodiment, the plurality of fasteners 5 helps connect, disconnect, and adjust the different components of the present invention according to the user's preferences. As seen in FIG. 1, FIG. 3, and FIG. 5, the plurality of fasteners 5 is detachably integrated between the plurality of hand grips 3 and the plurality of tension straps 4, as well as between the plurality of resistance bands 2 and the harness 1.

A more detailed description of the present invention follows.

Figure 8:
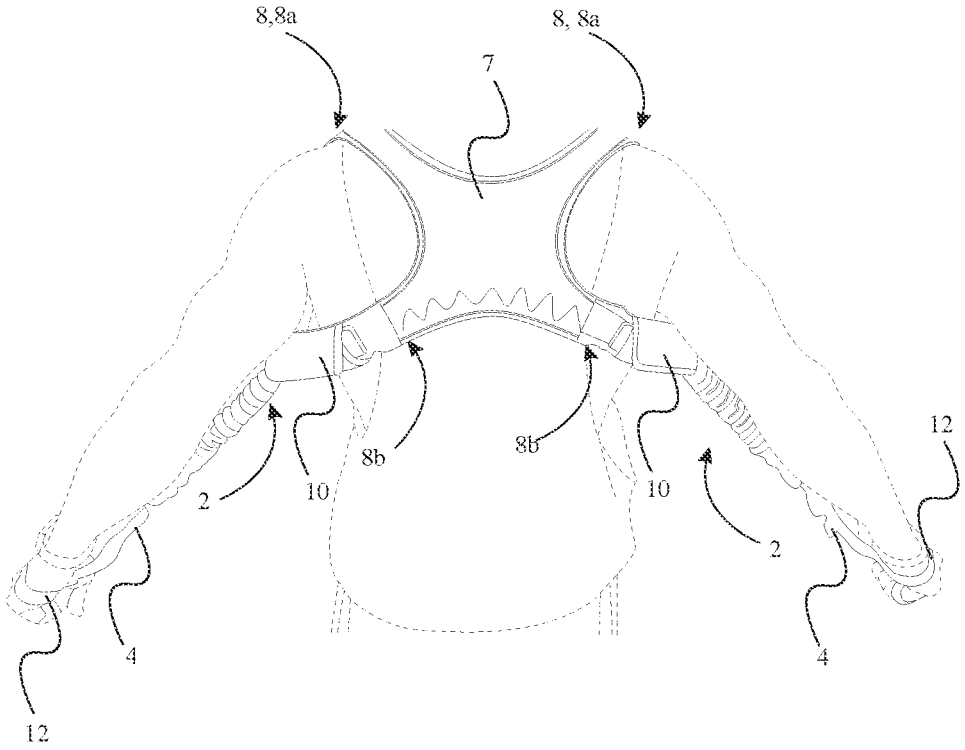
FIG. 8 is a rear perspective view of the invention being worn by the user.
Figure 9:
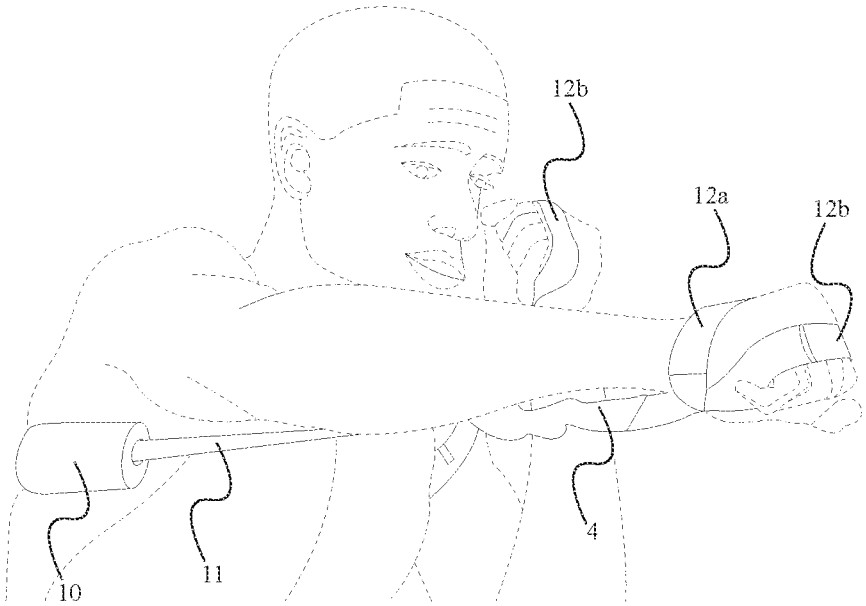
FIG. 9 is a front perspective view of the invention being used by a user.

According to the preferred embodiment, the harness 1 comprises a padded back support 7, a plurality of shoulder support pieces 8, and a plurality of harness fasteners 9, wherein the plurality of harness fasteners 9 is from the plurality of fasteners 5. Preferably, the padded back support 7 is connected between the plurality of shoulder support pieces 8. In other words, the padded back support 7 is designed to press against the back of a user and two shoulder support pieces 8 extend from two opposing ends of the padded back support 7. As seen in FIG. 3 and FIG. 8, each of the plurality of shoulder support pieces 8 comprises a first region 8*a* and a second region 8*b*, wherein the first region 8*a* is positioned opposite to the second region 8*b* across the padded back support 7. More specifically, the first region 8*a* constitutes a top region of the harness 1, and the second region 8*b* constitutes a lower region of the harness 1. Further, the plurality of adjustable shoulder straps 6 is positioned adjacent to the first region 8*a*, and the plurality of harness fasteners 9 is positioned adjacent to the second region 8*b*. In the preferred embodiment, the plurality of shoulder straps 6 are held by hook and loop fasteners and the plurality of harness fasteners 9 are buckle clips. However, the plurality of shoulder straps 6 and the harness fasteners 9 may comprise any other fastening technique that is known to one of ordinary skill in the art, as long as the intents of the present invention are not altered.

In order to provide comfort for the user while wearing the present invention, the present invention further comprises a plurality of protective coverings 10, wherein the plurality of protective coverings 10 laterally encompasses the plurality of harness fasteners 9. In other words, the plurality of protective coverings 10 protects the harness fasteners 9 from poking the user during the training process. As seen in FIG. 1, FIG. 3, and FIG. 8, the protective coverings 10 are padded sleeves with open terminal ends, that are connected with hook and loop fasteners. However, the protective coverings 10 may comprise any other size, shape, material, components, arrangement of components, fastening techniques etc., as long as the objectives of the present invention are not altered.

Continuing with the preferred embodiment, the present invention comprises a protective sleeve 11, wherein the protective sleeve 11 encapsulates each of the plurality of resistance bands 2. In other words, the plurality of resistance bands 2 are covered by a flexible fabric all around. This is so that, even if a resistance band breaks during the training process, it will stay inside the protective sleeve 11 and would not hurt the user or cause any accidents. The protective sleeve 11 may be made of any material and may have any dimensions, as long as the intent of the present invention is not altered.

Figure 4:
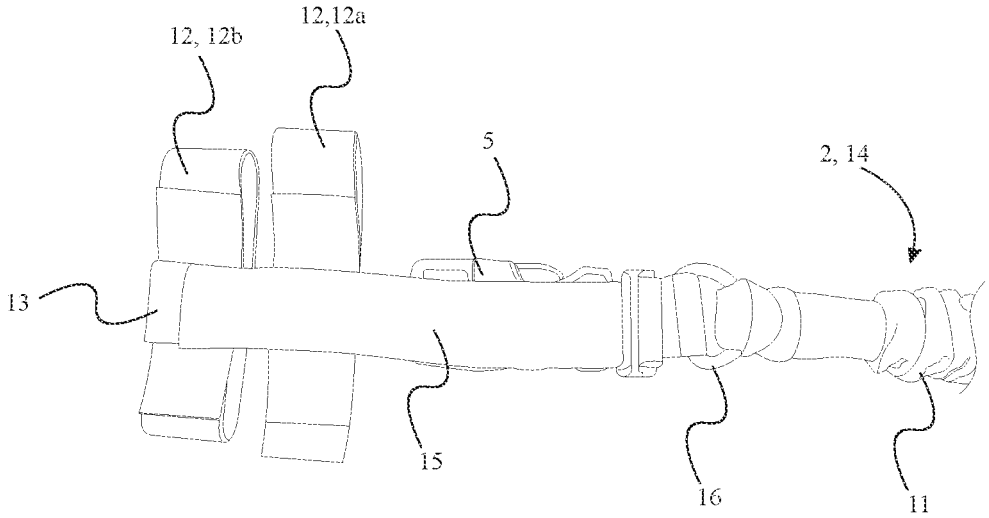
FIG. 4 is a bottom perspective view of a hand grip, a tension strap, and a portion of the resistance band.
Figure 6:
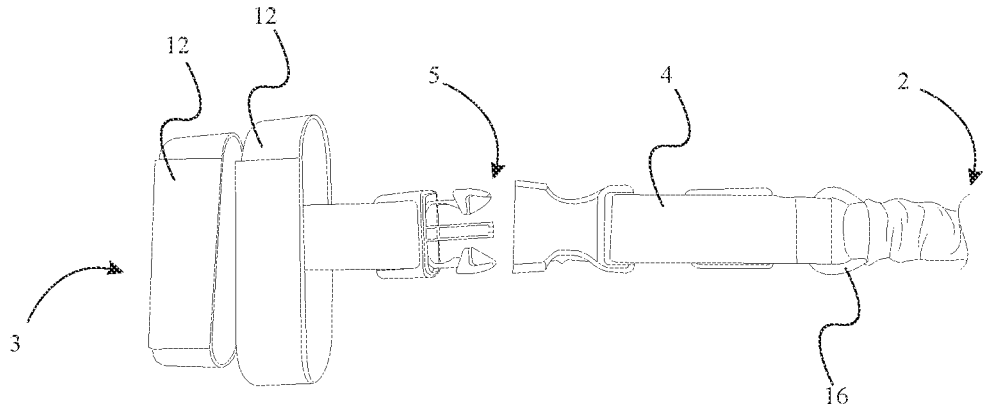
FIG. 6 is a top perspective view of the hand grip, and the tension strap, wherein the fastener connecting the tension strap and the hand grip is unfastened.
Figure 7:
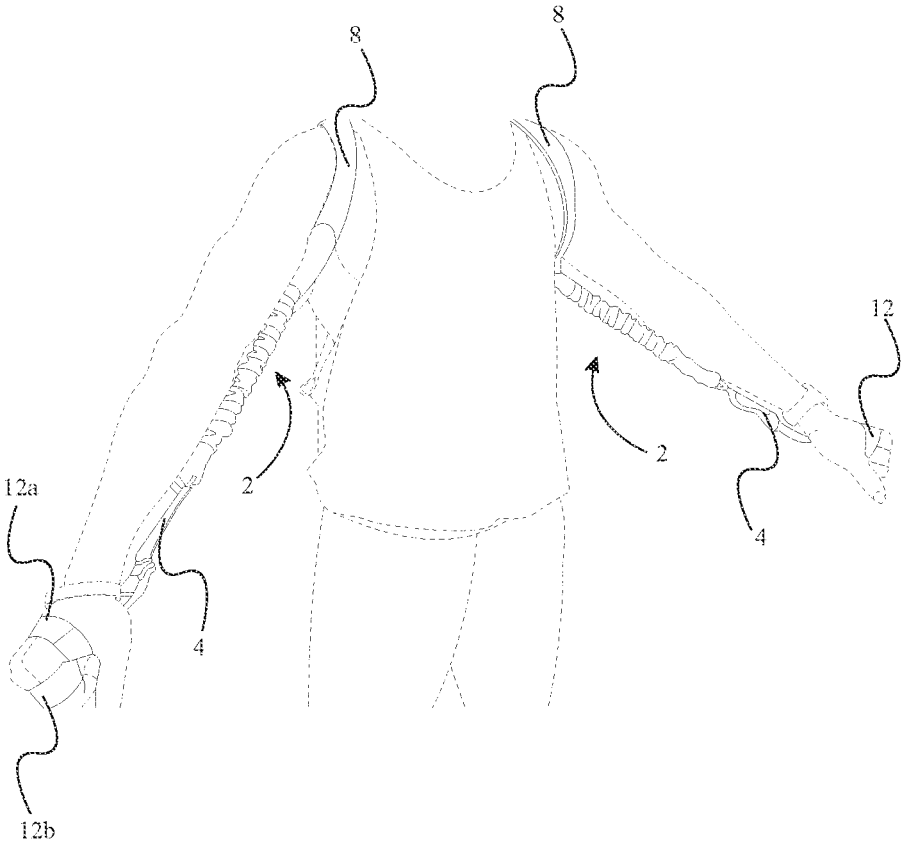
FIG. 7 is a front perspective view of the invention being worn by a user.

Continuing with the preferred embodiment, each of the plurality of hand grips 3 comprises a plurality of loops 12, and a connecting segment 13. As seen in FIG. 4 through FIG. 6, the plurality of loops 12 is oriented normally to each of the plurality of resistance bands 2, and the connecting segment 13 is mounted normally across the plurality of loops 12, connecting the plurality of loops. Further, the connecting segment 13 is positioned parallel to each of the plurality of resistance bands 2. Furthermore, each of the plurality of loops 12 is laterally offset from each other. This is so that, a first loop 12*a* from the plurality of loops 12 rests around the palm of the hand, and a second loop 12*b* from the plurality of loops 12 rests around the knuckle region of the hand, thereby giving the user a firm grip. Additionally, it is an aim of the present invention to provide a universal fit for the handgrips or the hand grip to fit around different hand sizes. To accomplish this, each of the plurality of loops 12 comprises a flexible segment 12*c* and a non-flexible segment 12*d*. The flexible segment 12*c* ensures flexibility, while the non-flexible segment 12*d* ensures structural stability for each of the plurality of hand grips.

According to the preferred embodiment, the tension level of each of the plurality of resistance bands may be adjusted according to the users' requirements with the help of the plurality of tension straps 4. In other words, the plurality of tension straps 4 is operably coupled to the plurality of resistance bands 2, wherein operating the tension straps 4 governs tension adjustment of a corresponding resistance band 14, wherein the corresponding resistance band 14 is from the plurality of resistance bands 2. To further accomplish this, the present invention comprises a tension strap tail 15, wherein the tension strap tail 15 is positioned along a terminal end of each of the plurality of the tension straps 4. The user can increase the tension by pulling the tension strap tail 15 and decrease the tension by releasing the tension strap tail 15. Further, in order to maintain the required tension level, the tension strap tail 15 is attached to the hang grip 3. More specifically, the tension strap tail 15 is detachably attached to the connecting segment 13 through a corresponding fastener, wherein the corresponding fastener is from the plurality of fasteners 5.

In the preferred embodiment, the plurality of fasteners 5 comprises adjustable fasteners 5*a* and non-adjustable fasteners 5*b*. As seen in FIG. 1 through FIG. 9, the adjustable fasteners 5*a* are hook and loop fasteners and the non-adjustable fasteners comprise snap buckles 5*b*. However, the adjustable and non-adjustable fasteners may comprise any other size, shape, fastening technology etc., that are known to one of ordinary skill in the art, as long as the intents of the present invention are not altered.

In reference to FIG. 4 through FIG. 6, the present invention comprises a plurality of connectors 16 for providing a more sturdy and secure connection. In the preferred embodiment, the plurality of connectors 16 is connected to terminal ends of each of the plurality of resistance bands 2. Preferably, the plurality of connectors are D-rings. However, any other connectors or connecting links may be used along any joint of the present invention, as long as the objectives of the present invention are fulfilled.

Although the invention has been explained in relation to its preferred embodiment, it is to be understood that many other possible modifications and variations can be made without departing from the spirit and scope of the invention as hereinafter claimed.

What is claimed is:

1. A multifunctional and adjustable resistance training device, comprising:

a) a harness;

b) a plurality of resistance bands;

c) a plurality of hand grips;

d) a plurality of tension straps;

e) a plurality of fasteners;

f) a plurality of adjustable shoulder straps;

g) the plurality of resistance bands being detachably connected between the harness and the plurality of tension straps;

h) the plurality of tension straps being connected between the plurality of resistance bands and the plurality of hand grips;

i) the plurality of adjustable shoulder straps being integrated along the harness;

the plurality of fasteners being detachably integrated between the plurality of hand grips and the plurality of tension straps, and between the plurality of resistance bands and the harness; and j) the plurality of resistance bands and the plurality of hand grips being flexible, wherein each of the plurality of hand grips comprising:

i. a plurality of loops;

ii. a connecting segment;

iii. the plurality of loops being oriented normal to each of the plurality of resistance bands;

iv. the connecting segment being mounted normally across the plurality of loops, connecting the plurality of loops; and v. the connecting segment being positioned parallel to each of the plurality of resistance bands.

2. The multifunctional and adjustable resistance training device of claim 1, wherein the plurality of fasteners comprises adjustable fasteners and non-adjustable fasteners.

3. The multifunctional and adjustable resistance training device of claim 2, wherein the adjustable fasteners are hook and loop fasteners and the non-adjustable fasteners comprise snap buckles.

4. The multifunctional and adjustable resistance training device of claim 1, comprising:

a) a plurality of connectors; and b) the plurality of connector being connected to terminal ends of each of the plurality of resistance bands.

5. The multifunctional and adjustable resistance training device of claim 1, wherein, each of the plurality of loops is laterally offset from each another.

6. The multifunctional and adjustable resistance training device of claim 1, wherein each of the plurality of loops comprises a flexible segment and a non-flexible segment.

7. The multifunctional and adjustable resistance training device of claim 1, comprising:

a) a tension strap tail;

b) the tension strap tail being positioned along a terminal end of each of the plurality of the tension straps; and c) the tension strap tail being detachably attached to the connecting segment through a corresponding fastener, wherein the corresponding fastener is from the plurality of fasteners.

8. The multifunctional and adjustable resistance training device of claim 4, wherein the plurality of connectors are D-rings.

9. A multifunctional and adjustable resistance training device, comprising:

a) a harness;

b) a plurality of resistance bands;

c) a plurality of hand grips;

d) a plurality of tension straps;

e) a plurality of fasteners;

f) a plurality of adjustable shoulder straps;

g) the plurality of resistance bands being detachably connected between the harness and the plurality of tension straps;

h) the plurality of tension straps being connected between the plurality of resistance bands and the plurality of hand grips;

i) the plurality of adjustable shoulder straps being integrated along the harness;

j) the plurality of fasteners being detachably integrated between the plurality of hand grips and the plurality of tension straps, and between the plurality of resistance bands and the harness;

k) the plurality of resistance bands and the plurality of hand grips being flexible; and l) the plurality of tension straps being operably coupled to the plurality of resistance bands, wherein operating the tension strap governs tension adjustment of a corresponding resistance band, wherein the corresponding resistance band is from the plurality of resistance bands, wherein each of the plurality of hand grips comprising:

i. a plurality of loops; a connecting segment;

ii. the plurality of loops being oriented normal to each of the plurality of resistance bands, wherein, each of the plurality of loops is laterally offset from each another;

iii. the connecting segment being mounted normally across the plurality of loops, connecting the plurality of loops; and iv. the connecting segment being positioned parallel to each of the plurality of resistance bands.

10. The multifunctional and adjustable resistance training device of claim 9, the harness comprising:

a) a padded back support;

b) a plurality of shoulder support pieces;

c) a plurality of protective coverings;

d) a plurality of harness fasteners, wherein the plurality of harness fasteners are from the plurality of fasteners;

e) each of the plurality of shoulder support pieces comprising a first region and a second region, wherein the first region is positioned opposite to the second region across the padded back support;

f) the padded back support connected between the plurality of shoulder support pieces;

g) the plurality of adjustable shoulder straps being positioned adjacent to the first region;

h) the plurality of harness fasteners being positioned adjacent to the second region; and i) the plurality of protective coverings laterally encompassing the plurality of harness fasteners.

11. The multifunctional and adjustable resistance training device of claim 9, comprising:

a) a protective sleeve; and b) the protective sleeve encapsulating each of the plurality of resistance bands.

12. The multifunctional and adjustable resistance training device of claim 9, comprising:

a) a tension strap tail;

b) the tension strap tail being positioned along a terminal end of each of the plurality of the tension straps; and c) the tension strap tail being detachably attached to the connecting segment through a corresponding fastener, wherein the corresponding fastener is from the plurality of fasteners.

13. The multifunctional and adjustable resistance training device of claim 9, wherein the plurality of fasteners comprises adjustable fasteners and non-adjustable fasteners.

14. The multifunctional and adjustable resistance training device of claim 9, comprising:

a) a plurality of connectors; and b) the plurality of connector being connected to terminal ends of each of the plurality of resistance bands.

* * * * *